US007527669B2

(12) United States Patent
Morrell et al.

(10) Patent No.: US 7,527,669 B2
(45) Date of Patent: May 5, 2009

(54) DISPLACEMENT METHOD AND APPARATUS FOR REDUCING PASSIVATED METAL POWDERS AND METAL OXIDES

(75) Inventors: Jonathan S. Morrell, Knoxville, TN (US); Edward B. Ripley, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 550 days.

(21) Appl. No.: 11/008,678

(22) Filed: Dec. 9, 2004

(65) Prior Publication Data

US 2005/0150327 A1 Jul. 14, 2005

Related U.S. Application Data

(60) Provisional application No. 60/528,368, filed on Dec. 10, 2003.

(51) Int. Cl.
*C22B 5/00* (2006.01)
*C22B 34/12* (2006.01)

(52) U.S. Cl. ..... 75/414; 75/615; 75/10.13

(58) Field of Classification Search ..... 75/414, 75/10.13, 615
See application file for complete search history.

(56) References Cited

U.S. PATENT DOCUMENTS

| | | | | |
|---|---|---|---|---|
| 2,043,363 | A * | 6/1936 | Alexander | 75/611 |
| 2,777,763 | A * | 1/1957 | Whaley | 75/614 |
| 2,830,893 | A * | 4/1958 | Reginald | 75/614 |
| 3,721,549 | A * | 3/1973 | Gallay et al. | 75/10.15 |
| 4,032,328 | A | 6/1977 | Hurd | |
| 4,519,837 | A | 5/1985 | Down | |
| 4,880,578 | A * | 11/1989 | Holcombe et al. | 264/432 |
| 5,211,742 | A * | 5/1993 | Amamoto | 75/399 |
| 6,277,168 | B1 | 8/2001 | Huang et al. | |
| 6,350,973 | B2 * | 2/2002 | Wroe et al. | 219/680 |
| 6,409,791 | B1 * | 6/2002 | Petit et al. | 75/10.14 |

FOREIGN PATENT DOCUMENTS

| | | |
|---|---|---|
| GB | 729503 | 5/1955 |

* cited by examiner

*Primary Examiner*—Roy King
*Assistant Examiner*—Tima M McGuthry-Banks
(74) *Attorney, Agent, or Firm*—Michael J. Renner; Luedeka, Neely & Graham, P.C.

(57) ABSTRACT

A method of reducing target metal oxides and passivated metals to their metallic state. A reduction reaction is used, often combined with a flux agent to enhance separation of the reaction products. Thermal energy in the form of conventional furnace, infrared, or microwave heating may be applied in combination with the reduction reaction.

32 Claims, 6 Drawing Sheets

DISPLACEMENT METHOD AND APPARATUS FOR REDUCING PASSIVATED METAL POWDERS AND METAL OXIDES

CROSS REFERENCE TO RELATED APPLICATIONS

This patent application claims priority from and is related to U.S. Provisional Patent Application Ser. No. 60/528,368, "Displacement Method for Reducing Passivated Metal Powders and Metal Oxides," Jonathan S. Morrell and Edward B. Ripley, filed Dec. 10, 2003.

The following patent applications are incorporated by reference into this application:

U.S. Provisional Patent Application Ser. No. 60/528,368, "Displacement Method for Reducing Passivated Metal Powders and Metal Oxides," Jonathan S. Morrell and Edward B. Ripley, filed Dec. 10, 2003.

Co-owned U.S. patent application Ser. No. 11/008,655, "Vessel with Filter and Method of Use," Jonathan S. Morrell, Edward B. Ripley, and David M. Cecala, filed Dec. 9, 2004.

The U.S. Government has rights to this invention pursuant to contract number DE-AC05-00OR22800 between the U.S. Department of Energy and BWXT Y-12, L.L.C.

FIELD OF THE INVENTION

This invention pertains to the reduction of metal oxides and passivated metals to their metallic state.

BACKGROUND

Like many metals, the so-called transition metals of the periodic table, such as titanium, vanadium, niobium, tantalum, chromium, molybdenum, and tungsten are typically found in nature as oxides, hydrous oxides, or hydroxides. For example, titanium is found naturally as rutile ore, which is preponderantly $TiO_2$. The natural ores of many of these transition metals include additional metals such as lead, iron, calcium, or magnesium. For example, vanadium is primarily obtained from the minerals vanadinite ($Pb_5(VO_4)_3Cl$) and carnotite ($K_2(UO_2)_2VO_4.1\text{-}3H_2O$). Niobium is primarily obtained from the minerals columbite ((Fe, Mn, Mg)(Nb, Ta)$_2O_6$) and pyrochlore ((Ca, Na)$_2Nb_2O_6$(O, OH, F)). Various chemical and physical processes may be used to isolate the desired transition metal and purify it as an oxide. However, the chemical reduction of the metal oxides to elemental metal is often difficult. For example, the production of titanium metal from rutile ore is generally accomplished by what is known as the Kroll process, and is described in U.S. Pat. No. 2,205,854 which issued Jun. 25, 1940. This process involves dropping or spraying liquid titanium tetrachloride into molten magnesium to produce titanium metal and magnesium chloride. A variation on this process, called the Hunter process, substitutes liquid sodium for the liquid magnesium, and produces titanium metal and sodium chloride.

In addition to natural or processed ores, metal oxides are also formed on the surfaces of manufactured metal powders. In some cases these oxides are produced deliberately and in other cases, particularly with metal powders, these oxide layers are undesired but occur simply by exposure of the powder to air. This surface oxidation effect is called passivation. It is often desirable to remove these oxide coatings while minimizing the removal or conversion of the underlying metal. Removal of these coatings is challenging because of difficulties that occur separating the mixtures that are created by most chemical removal processes.

In the sixty-some years since the introduction of the Kroll process, many alternative processes have been proposed and some have been patented, but none has replaced the Kroll process to any significant extent. This long history of attempts to replace the Kroll process attests to the need to develop alternative processes that are safer, faster, less expensive and create less waste in the conversion of transition metal oxides, metal oxides and passivated metal powders to elemental metal.

SUMMARY

Many of the foregoing and other needs are met by processes that utilize chemically reactive metal in a displacement reaction to reduce target metal oxides to elemental metal.

A preferred embodiment of the invention involves placing a quantity of a target metal oxide comprising an elemental metal in a vessel and placing a quantity of reactive metal in the vessel. The reactive metal is a metal that reacts exothermally in a displacement reaction when heated with the target metal oxide. The reactive metal has a predominant stable oxide that is more chemically stable than the target metal oxide. The process further comprises establishing an environment of non-reactive atmosphere in the vessel. Then, while in an environment of the non-reactive atmosphere, the process continues with heating the contents of the vessel to a first temperature sufficient to reduce at least a portion of target metal oxide to the elemental metal and to oxidize at least a portion of the reactive metal to the predominant stable oxide. Then the process continues with heating the contents of the vessel to a second temperature that is sufficient to melt the elemental metal.

In some embodiments, a flux agent is placed in the vessel, wherein the flux agent has a molten density that is between (a) the molten density of the predominant stable oxide of the metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal.

Another embodiment involves placing a quantity of a target metal oxide comprising an elemental metal in a first vessel and placing a quantity of a reactive metal in a second vessel. The reactive metal is a metal that reacts in an exothermic displacement reaction when heated with the target metal oxide, and the reactive metal has a predominant stable oxide that is more chemically stable than the target metal oxide. The process continues by establishing a combination of temperatures of the contents of the first vessel and the second vessel that is at least sufficient to substantially melt and separate into molten layers the contents of the vessels after the contents of the vessels are combined and an exothermic displacement reaction occurs. The process further includes providing a non-reactive atmosphere in a combination vessel. Then, while in an environment of the non-reactive atmosphere; the process continues with combining the contents of the first vessel with the contents of the second vessel whereby the exothermic displacement reaction occurs and at least a portion of the target metal oxide is reduced to the elemental metal and at least a portion of the reactive metal is oxidized to the predominant stable oxide and the elemental metal is substantially melted. Some embodiments also include placing a flux agent in one or both vessels wherein the flux agent's molten density is between (a) the molten density of the predominant stable oxide of the reactive metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal.

In a further embodiment, elemental metal is produced by placing a quantity of a target metal oxide comprising an elemental metal, and a quantity of reactive metal, in a crucible that at ambient temperature absorbs microwave energy. The reactive metal (a) is a metal that reacts exothermally in a displacement reaction when heated with the target metal oxide, (b) is maintained in the crucible in an environment of non-reactive atmosphere, and (c) has a predominant stable oxide that is more chemically stable than the target metal oxide. The process continues with placing the crucible in a thermal insulator that is substantially transparent to microwave radiation. Then, while maintaining an environment of non-reactive atmosphere in the crucible, the process continues by using microwave energy at least in part, to heat the crucible and the target metal oxide and the reactive metal until an exothermic displacement reaction occurs whereby at least a portion of the target metal oxide is reduced to the elemental metal and at least a portion of the reactive metal is oxidized to the predominant stable oxide.

In another embodiment, elemental metal is produced by placing a quantity of a target metal oxide comprising an elemental metal and a quantity of reactive metal in a vessel wherein the reactive metal is a metal that reacts exothermally in a displacement reaction when heated with the target metal oxide. The reactive metal is maintained in the vessel in an environment of non-reactive atmosphere, and the reactive metal has a predominant stable oxide that is more chemically stable than the target metal oxide. The process continues by placing a flux agent in the vessel, wherein the flux agent has a molten density that is between (a) the molten density of the predominant stable oxide of the metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal. Then, while maintaining an environment of non-reactive atmosphere in the vessel, the process proceeds by heating the vessel and the target metal oxide and the reactive metal and the flux agent until an exothermic displacement reaction occurs whereby at least a portion of the target metal oxide is reduced to the elemental metal and at least a portion of the reactive metal is oxidized to the predominant stable oxide, and the elemental metal is melted and the flux separates the melted elemental metal from the other contents of the vessel.

In yet another embodiment of this invention, metallic titanium is produced while in a non-reactive atmosphere, by placing a quantity of titanium dioxide and a quantity of lithium and barium chloride in a crucible composed substantially of magnesium oxide. The crucible comprises a vessel with filtration media. The quantity of the lithium is not less than approximately stoichiometrically equivalent to the quantity of the titanium dioxide. The process proceeds with placing the crucible in an alumina casket. Then, while maintaining an environment of inert atmosphere in the crucible, the process proceeds by heating the crucible and the quantity of the titanium dioxide and the quantity of the lithium and the quantity of the barium chloride to a first temperature, using microwave energy at least in part, where the first temperature is just sufficiently high enough that the quantity of titanium dioxide and the quantity of lithium reacts in an exothermic displacement reaction. Substantially all of the quantity of the titanium dioxide is reduced to elemental titanium metal and substantially all of the quantity of the lithium is oxidized to lithium oxide. The process proceeds with further heating the crucible and the contents of the crucible to a second temperature that is higher than the first temperature, using microwave energy at least in part, so that any stoichiometric excess of the quantity of the lithium, the lithium oxide, the barium chloride, and the elemental titanium metal are substantially melted and separated into molten layers.

Some alternate embodiments may add additional steps of coarsely grinding the quantity of the target metal oxide prior to placing it in the vessel (referred to as a crucible when heated with microwave energy), and, while in an environment of non-reactive atmosphere, coarsely grinding the quantity of the reactive metal prior to placing it in the vessel; and coarsely grinding the flux agent prior to placing it in the vessel; and, while in an environment of non-reactive atmosphere, substantially mixing the quantity of the target metal oxide and the quantity of the reactive metal and the flux agent in the vessel prior to placing the flux agent in the vessel.

An apparatus embodiment is defined for reducing a target metal oxide to elemental metal. The apparatus comprises a vessel that is chemically compatible with a target metal oxide comprising an elemental metal. Means for placing a quantity of target metal oxide in the vessel is provided, together with means for placing a quantity of reactive metal into the vessel. An environment of non-reactive atmosphere that surrounds and fills the vessel is provided. Also provided is means for heating the contents of the vessel in the environment of non-reactive atmosphere to a first temperature sufficient to reduce at least a portion of the target metal oxide to the elemental metal, to oxidize at least a portion of the reactive metal to a predominant stable oxide, and to heat the elemental metal to a second temperature sufficient to substantially melt the elemental metal.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
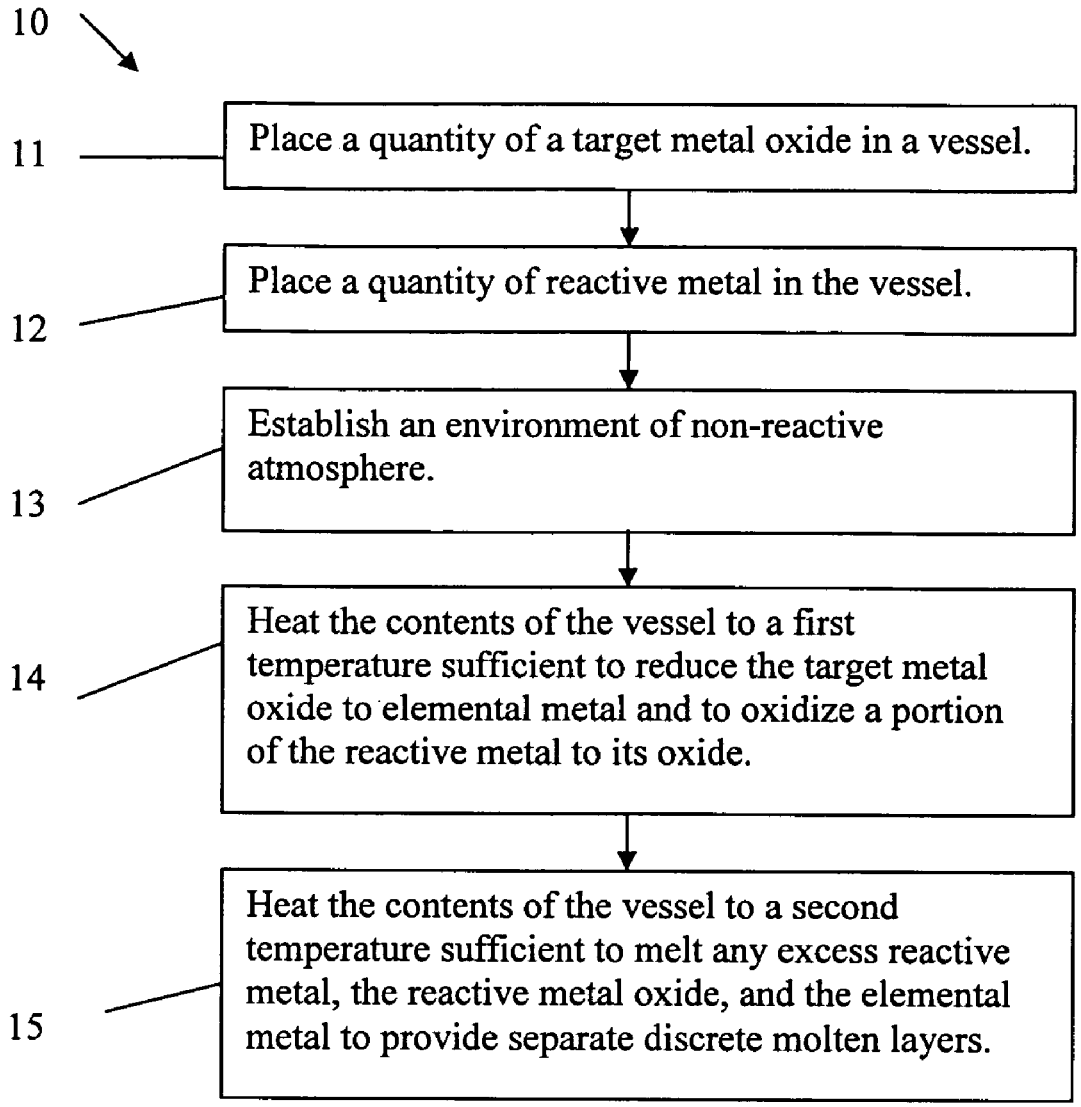
FIG. 1 is a flow chart of a method according to the invention.

Described next are several embodiments of this invention.

Several different processes using displacement reactions may be used to convert target metal oxides and metal powders with passivating oxide layers to elemental metal. In order to perform a displacement reaction with titanium dioxide, for example, a reactive metal with a more stable oxide than titanium dioxide must be identified. In the case of titanium dioxide reduction, a choice among magnesium, calcium and lithium would meet that criterion as the reactive metal. For example, if a mixture of titanium dioxide powder and excess lithium granules is heated, the following reaction will occur:

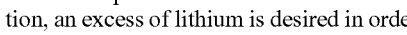

$$TiO_2+Li\ (excess) \rightarrow Ti+Li_2O+Li\ (residual)$$

This reaction works because lithium is a stronger reducing agent than titanium, and the predominant stable oxide of lithium ($Li_2O$) is more stable than the predominant stable oxide of titanium ($TiO_2$). The term "predominant stable oxide" refers to the particular oxide of the metal that is the most thermodynamically and chemically stable. For example, there is another oxide of lithium (lithium peroxide—$Li_2O_2$), but it is only stable up to 195 deg. C. Continuing with the explanation of the titanium dioxide reduction reaction, an excess of lithium is desired in order to ensure that all of the target metal oxide is reduced to titanium metal. If less than an stoichiometric equivalent of Li is used, the reaction will work but not all the $TiO_2$ will be converted to Ti metal. Thus, Li is the limiting reagent.

As previously indicated, the titanium dioxide reduction reaction works because lithium is a stronger reducing agent than titanium. More precisely, the reaction proceeds (Li reacts with $TiO_2$) because Li has the higher ionization potential (i.e., Li is higher in the electromotive series). As long as the reducer (Li in this case) is higher in the electromotive series (more negative standard potential) than the metal oxide, the reaction will proceed. However, the smaller the difference in the standard potential, the more slowly the reaction will take place. In cases where metals have several oxidation states, factors such as the relative position of the metals in the activity series, the relative availability of oxygen in the process, and the relative stability of the various oxides will determine if the reaction takes place and how it concludes.

In practice, the target metal oxide may be in mineral form and contain impurities, but preferably its metallic content is predominantly comprised of the elemental metal (titanium in this case) for which reduction is desired. Various known processes are available to purify $TiO_2$ from naturally occurring ores such as ilmenite (60% $TiO_2$) to more pure forms of $TiO_2$ if that is needed to enhance the purity of the final Ti product produced by the present invention. For example, the "Advanced Becher Process" can be used to convert ilmenite to synthetic rutile (92% $TiO_2$), and then the Kerr McGee Process used to upgrade that material to paint-grade rutile (99.9% $TiO_2$). Because $TiO_2$ is used as a pigment in paint it is readily available commercially in bulk quantities at controlled purity levels.

Generally, reactions of this type need to be conducted under a non-reactive atmosphere. The non-reactive atmosphere is designed to preclude any significant interference from the surrounding gaseous environment on the chemical process, such as re-oxidation of the elemental metal as it is produced. In many reactions it is also necessary to prevent the reactive metal from oxidizing (sometimes violently, depending on the specific reactive metal) in the surrounding atmosphere before it can react with the target metal oxide. One way to prevent that is by sealing the reactive metal with a coating that separates the reactive metal from the surrounding atmosphere. In such embodiments, the coating acts as a non-reactive atmosphere. The coating is then burned off as the reactants are heated to start the reaction process. Another method of preventing premature oxidation of the reactive metal in the surrounding atmosphere is to introduce the reactive metal into the reaction vessel under the protection of a gaseous non-reactive atmosphere pre-established in the reaction vessel. The gaseous non-reactive atmosphere may extend from the environment where the reactive metal is removed from storage, through a reactive metal transportation link, to the reactive vessel. The selection of the composition of a specific non-reactive atmosphere depends upon the specific reduction process. For example, in reducing vanadium, the only requirement is removing oxygen, so CO may be used as a gas getter to take the oxygen out as $CO_2$. In some instances the non-reactive atmosphere is comprised substantially of an inert gas such as argon. In some cases the non-reactive atmosphere may be a vacuum. In other instances, substantially dry atmospheric air may suffice. In a few reactions the non-reactive atmosphere is simply ambient air. The distinguishing characteristic of a non-reactive atmosphere is that when chemical reaction processes are conducted within it, the non-reactive atmosphere does not obstruct or alter the completion of the desired chemical reactions in any significant manner.

Depending upon ambient conditions the reaction may take place spontaneously or a small amount of thermal energy may be required to initiate it. For some reduction reactions a drop of water may trigger the reaction. In the case of the titanium reduction reaction, once the reaction is started, it will proceed exothermically, with the change in energy (Delta G) calculated to be −38.61 kcal/mole. However, this reaction will not generate enough heat to increase the temperature of the reaction products to the melting points of the reaction products, so they are all agglomerated rather than being separated into distinct physical portions. At this point, the elemental metal is typically a sponge that may be mechanically or chemically separated from the other reaction products. To extract the titanium, the reaction products may be ground and dissolved in a low molecular concentration of acid (such as 3 molar hydrochloric acid). The titanium metal may then be filtered and consolidated, and the remaining solution is then evaporated leaving a lithium chloride salt.

One method of separating titanium from titanium sponge is to vacuum distill the Ti sponge in a vacuum distilling apparatus to remove residual salt or otherwise treat the sponge to remove residual salt, then electrolyze the Ti sponge in an electrolytic cell by fused salt electrolysis, and then melt the Ti using an electron-beam furnace or similar high-vacuum melting process. Other methods are provided in U.S. Pat. Nos. 5,772,724, "High purity titanium production process," and 5,582,629, "Treatment process of sponge titanium powder."

The lithium may be recovered from the chloride salt using a lithium electrolytic cell process. (See Journal of Metals, 38 (11), 20-26, 1986, for an article on recovering lithium by molten salt electrolysis.)

In an alternate embodiment, a furnace may be used to supplement the exothermic heat produced by the reduction reaction. Heat energy for the furnace may be provided by infrared energy, induction heating, natural gas firing, resistance heating, or preferably by microwave heating. As previously indicated, lithium, calcium, or magnesium may be used as the reactive metal. However, as a practical matter in this embodiment, the choice of reactive metal is preferably made such that the target metal oxide of the reactive metal has a melting point approximately less than about 1700° C. The reasons for this are that (a) most industrial furnaces are not easily able to achieve temperatures higher than that temperature, and (b) for economic and safety reasons, temperatures below that level are preferred. Thus, for titanium dioxide reduction, lithium is the preferred choice for the reactive metal because lithium oxide melts at 1570° C. Calcium is not preferred because it forms calcium oxide that melts at approximately 2800° C., and that exceeds the desired upper temperature limit of 1700° C. Magnesium is not preferred because it forms magnesium oxide that melts at approximately 3000° C., which also exceeds the desired upper temperature limit.

In a further preferred embodiment, a flux agent may be added to facilitate the separation of the elemental metal (titanium, for example) from the more stable target metal oxide of the reactive metal (lithium, for example). Preferably, the flux agent should have a molten density (i.e., a density while in the molten state) that is between the molten density of the elemental metal (titanium here) and the molten density of the predominant stable oxide of the reactive metal (lithium oxide, here). A flux agent that meets that molten density criteria is referred to as an intermediate density flux agent. Preferably, the flux agent should not significantly react with the target metal oxide, or with the reactive metal, or with the elemental metal of the target metal oxide, or with the predominant stable oxide of the reactive metal. A flux agent that meets these non-reactive criteria is referred to as an inert flux agent. Preferably the flux agent should have a melting temperature that is not significantly higher than the melting temperatures of the elemental metal and the more stable target metal oxide. It is also desirable that the flux agent be a salt of the reactive metal to allow for better recovery of the reducing agent. In titanium dioxide reduction, barium chloride is an excellent choice as the flux agent in part because it has a molten density between the molten densities of titanium and lithium oxide, and the melting temperature of barium chloride is also less than the melting temperature of both the titanium and the lithium oxide. It is also beneficial to use barium chloride because, at the temperatures employed in this process, barium chloride does not significantly react with titanium dioxide, or with lithium, or with titanium, or with lithium oxide. Ideally, the flux agent would be a salt of lithium (e.g., LiCl), because that would not introduce another metal into the process and that would facilitate recovery of the lithium for recycle. However, because LiCl has a boiling point of 1360° C., it would vaporize in this reaction and therefore it is not the preferred flux agent. $Ba_2Cl$ has a boiling point of about 1560° C. Thus some of it will vaporize but not before it facilitates the separation of the elemental metal (titanium, for example) from the more stable target metal oxide of the reactive metal (lithium, for example). These desired properties (intermediate density, non-reactivity, and appropriate melting temperature) of the flux agent achieve significant benefits for the reduction of target metal oxides.

The melting points and densities of the chemicals involved in titanium oxide reduction are as follows.

| Chemical | Melting Point | Density |
|---|---|---|
| $TiO_2$ | 1843° C. | 4.23 g/cm$^3$ |
| Ti | 1668° C. | 4.506 g/cm$^3$ |
| Li | 180.5° C. | 0.534 g/cm$^3$ |
| $Li_2O$ | 1570° C. | 2.013 g/cm$^3$ |
| $BaCl_2$ | 962° C. | 3.9 g/cm$^3$ |

In a reaction including a flux agent such as $BaCl_2$, the following reaction occurs:

$$TiO_2+Li\ (excess)+BaCl_2 \rightarrow Ti+Li\ (surplus)+2Li_2O+BaCl_2$$

To separate the titanium metal, the $BaCl_2$ along with the $Li_2O$ and any remaining Li may be dissolved in hydrochloric acid. The Ba+2 ion in solution may be precipitated out by adding sulfuric acid. The liquid remaining contains lithium and chloride ions and may be filtered from the solid barium sulfate. The solution may then be boiled and the remaining solid (lithium chloride) may be processed in the previously-described lithium electrolytic cell to recover the lithium metal.

In a preferred embodiment, the target metal oxide and the reactive metal are coarsely ground. The definition of "coarsely ground" is dependent upon the scale of operation. In this specific experiment the materials were ground to approximately 6 mesh or less. For multi-ton production batches it is expected that the coarsely ground target metal oxide pieces may be the size typically produced by a standard ore processing jaw crusher, with most of the larger pieces being typically 15mm in rough diameter or less. The pieces of reactive metal may be approximately the same size. Some additional benefit is achieved if the target metal oxide and reactive metal pieces are mixed together prior to initiating the reduction reaction.

Some alternate embodiments, including but not limited to embodiments that incorporate a flux agent, may include the use of a vessel with filtration media as disclosed in the related patent application incorporated by reference. The filtration media is used as a chemical trap to substantially capture reaction product off-gasses such as vaporized reactive metal or vaporized flux agent. Typically the filtration media comprises material that has a higher melting temperature than the temperature of the reaction product off-gasses.

In preferred embodiments the crucible is selected to be non-reactive (i.e., "chemically compatible") with both the reactants and the reaction products and, the crucible is also selected to be a susceptor to microwave energy. For example, crucibles comprising MgO are susceptors to microwave energy. However, because some wetting of the MgO crucible by some metals (such as titanium) may occur, and some slight reactivity of MgO may occur with some metals (such as titanium), a yttria ($Y_2O_3$) crucible may be used since yttria is a microwave susceptor, and a yttria crucible is preferred for use with metals that would react with MgO. The crucible is closed with a lid and the configuration includes a vent to permit off-gassing while trapping metal vapor that would contaminate the furnace when the reduction process occurs. Any other material that has a higher melting temperature than the reaction product may be used for the vent. In the case of titanium oxide reduction, a filtration media comprising calcium oxide is preferred. It is also advantageous to place the crucible inside a thermal insulator, such as a thermally insulating ceramic aluminum oxide casket.

In further preferred embodiments the crucible is selected to be a susceptor of microwave energy, and microwave energy is used to heat the crucible. In these embodiments it is preferred to surround the crucible with a thermally insulating ceramic casket that is substantially transparent to microwave radiation, such as an aluminum oxide casket. In this configuration the microwave energy passes through the casket to heat the suscepting crucible.

In an alternate embodiment, the temperature of the crucible and its contents may be increased by further application of energy from the furnace until the contents are substantially melted and separated into layers.

In another alternate embodiment, a flux agent such as $BaCl_2$ may be added to, and optionally mixed with, the reactants to facilitate the separation of the titanium metal from the lithium oxide after the displacement reaction occurs and the contents of the crucible are melted. In this embodiment, once the reaction products are heated to approximately 1700° C., the reaction products and excess lithium metal are in a molten state and separate out due to their densities, from the lightest to the heaviest: $Li/Li_2O/BaCl_2/Ti$. At this point the molten titanium metal then may be removed by such known techniques as opening a tap hole near the bottom of the crucible or pouring the contents of the crucible using a slag control shape or body. Alternately, the crucible may be allowed to cool and the titanium metal then may be easily separated from the slag layers (LiCl, $Li_2O$, and Li). The slag material then may be recycled to recover the lithium metal by a process such as the lithium electrolytic cell process previously described.

Another embodiment exploits the heat of reaction to drive the reaction process above the melting temperature of both the target metal oxide and the reactive metal, inducing substantially complete phase separation between the metal and oxide phases after the displacement reaction occurs. For example, the target metal oxide (e.g., $TiO_2$) may be heated in a vessel under a non-reactive atmosphere, and the reactive metal (e.g., lithium) and optionally a flux agent may be heated in a separate vessel. Typically at least one of the constituents is heated at least to its melting point. For example, lithium and optionally barium chloride may be heated to approximately 1000° C., and the target metal oxide may be heated to approximately the same temperature. Then the materials are combined into a single vessel thereby causing the exothermic reaction to take place. The added heat of reaction causes all of the combined materials to melt and separate into layers. The required combination of temperatures necessary to accomplish this is best determined by trial and error. Variables such as mixing solubility effectiveness, apparatus heat losses, and reaction kinetics have an effect on the temperature used. Once temperature parameters are determined by trial and error for a particular chemistry and process apparatus, the results are quite repeatable.

When all the materials are at their desired temperature, the molten reactive metal (e.g., Li) and optionally the molten flux agent (e.g., $BaCl_2$) are added to the vessel containing the target metal oxide, in which case the vessel containing the target metal oxide is the "combination vessel." In an alternate embodiment, the target metal oxide may be added to the vessel containing the reactive metal and optionally the flux agent, in which case the vessel containing the reactive metal and optionally the flux agent is the "combination vessel." In a further alternate embodiment, the target metal oxide and the reactive metal and optionally the flux agent may all be combined in a separate "combination vessel" where the reduction reaction would take place. The embodiment using a separate combination vessel is particularly useful in a continuous production process. The heat generated by the resultant exothermic reaction is sufficient to drive the temperature of substantially all of the reactants and optionally the flux agent above their melting temperatures. At these temperatures the materials separate into layers as suggested in the previously described embodiment.

Turning now to the figures, FIG. 1 illustrates a particular method 10 according to the invention. Method 10 begins at step 11 placing a quantity of a target metal oxide in a vessel. The target metal oxide comprises an elemental metal. This is followed by step 12 in which a quantity of reactive metal is placed in the vessel. The reactive metal is a metal that reacts exothermally in a displacement reaction when heated with the target metal oxide. The reactive metal also has a predominant stable oxide that is more chemically stable than the target metal oxide. Also the quantity of reactive metal is not less than approximately stoichiometrically equivalent to the quantity of target metal oxide in the vessel. In some embodiments a flux agent is also added in the vessel, where the flux agent has a molten density that is between (a) the molten density of the predominant stable oxide of the metal and (b) the molten density of the elemental metal of the target metal oxide, and where at the temperatures employed in this process the flux agent does not significantly react with the target metal oxide, or with the reactive metal, or with the elemental metal of the target metal oxide, or with the predominant stable oxide of the reactive metal. Step 13 establishes an environment of non-reactive atmosphere in the vessel, and in step 14, while in the environment of the non-reactive atmosphere, the contents of the vessel are heated to a first temperature that is sufficient to reduce the target metal oxide to the elemental metal and to oxidize a portion of the reactive metal to the predominant stable oxide. Then in step 15, the contents of the vessel are heated to a second temperature that is (a) sufficient to melt any stoichiometric excess of the reactive metal, the predominant stable oxide of the reactive metal, the flux agent (if used), and the elemental metal of the target metal oxide, and (b) sufficient to provide separate discrete molten layers. At this point, the molten elemental metal may be removed (in a step not shown) by such techniques as opening a tap hole in the vessel or pouring the contents of the vessel using a slag control shape or body. Alternately, the crucible may be allowed to cool and the titanium metal may be mechanically separated from the other reaction products.

Figure 2:
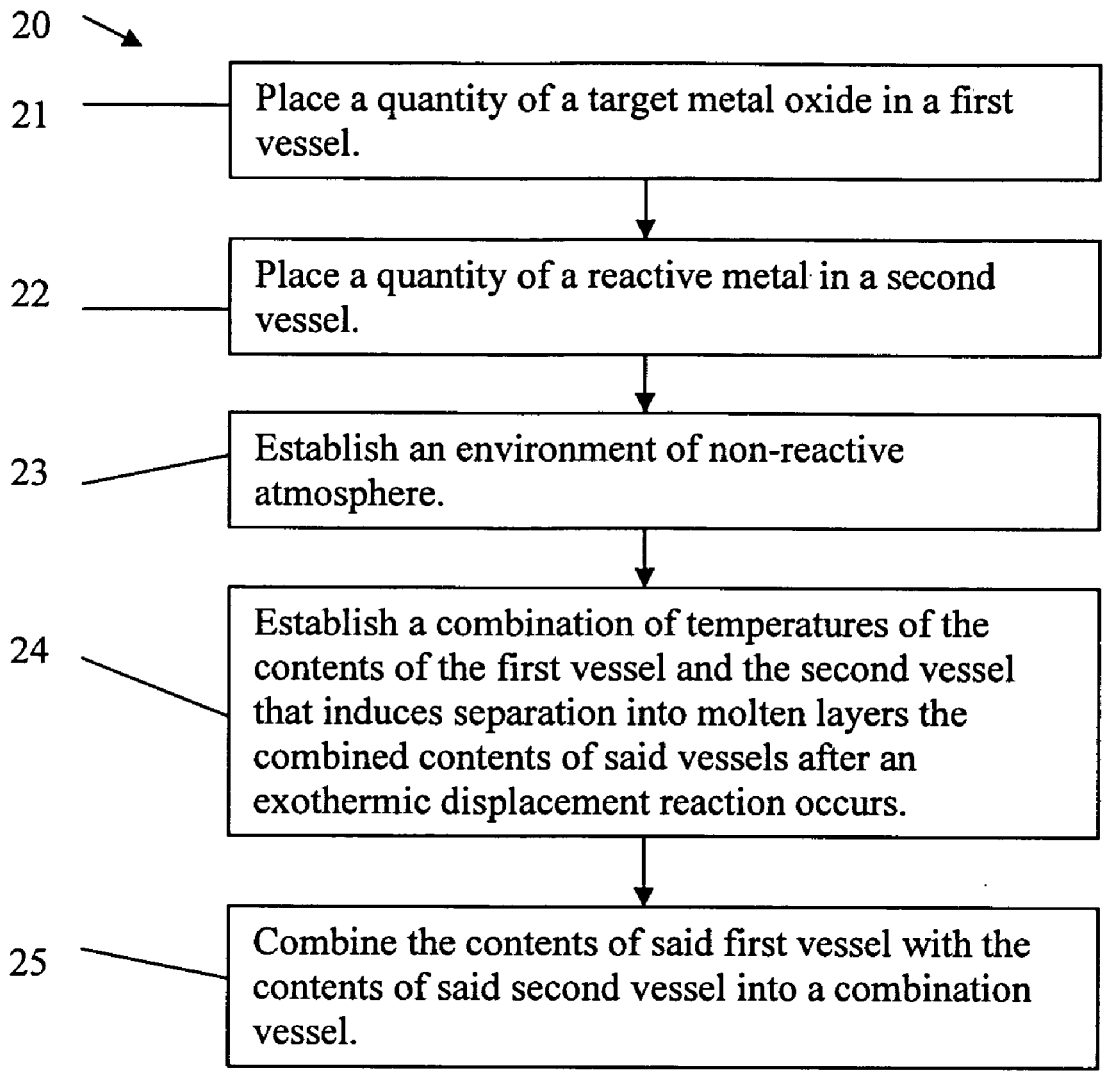
FIG. 2 is a flow chart of a method according to the invention.

FIG. 2 depicts another method of the invention, method 20. Method 20 begins with step 21 where a quantity of a target metal oxide comprising an elemental metal is placed in a first vessel. In step 22, a quantity of a reactive metal is placed in a second vessel. The reactive metal (a) is a metal that reacts in an exothermic displacement reaction when heated with the target metal oxide, and (b) has an oxide state that is more chemically stable than the target metal oxide. Also the quantity of reactive metal is not less than approximately stoichiometrically equivalent to the quantity of target metal oxide in the vessel. Optionally a flux agent may be placed in one or both vessels where the flux agent's molten density is between (a) the molten density of the predominant stable oxide of the reactive metal and (b) the molten density of the elemental metal of the target metal oxide, and where at the temperatures employed in this process the flux agent does not significantly react with the target metal oxide, or with the reactive metal, or with the elemental metal of the target metal oxide, or with the predominant stable oxide of the reactive metal. Then according to step 23, an environment of non-reactive atmosphere is established. In step 24, a combination of temperatures of the contents of the first vessel and the second vessel is established. The combination of temperatures is sufficiently high that it induces the combined contents of the vessels to separate into molten layers after an exothermic displacement reaction occurs. Then in step 25, again while in an environment of non-reactive atmosphere, the contents of the first vessel are combined with the contents of the second vessel into a combination vessel. In the combination vessel an exothermic displacement reaction occurs and substantially all of the target metal oxide is reduced to the elemental metal and an approximately stoichiometric portion of the reactive metal is oxidized to the predominant stable oxide, and whereby any stoichiometric excess of the reactive metal, as well as the predominant stable oxide of the reactive metal and the elemental metal of the target metal oxide are substantially melted and separated into molten layers. Then, in a step not shown, the molten elemental metal may be removed by such known techniques as opening a tap hole in the vessel or pouring the contents of the vessel using a slag control shape or body. Alternately, the crucible may be allowed to cool and the titanium metal may be mechanically separated from the other reaction products.

Figure 3:
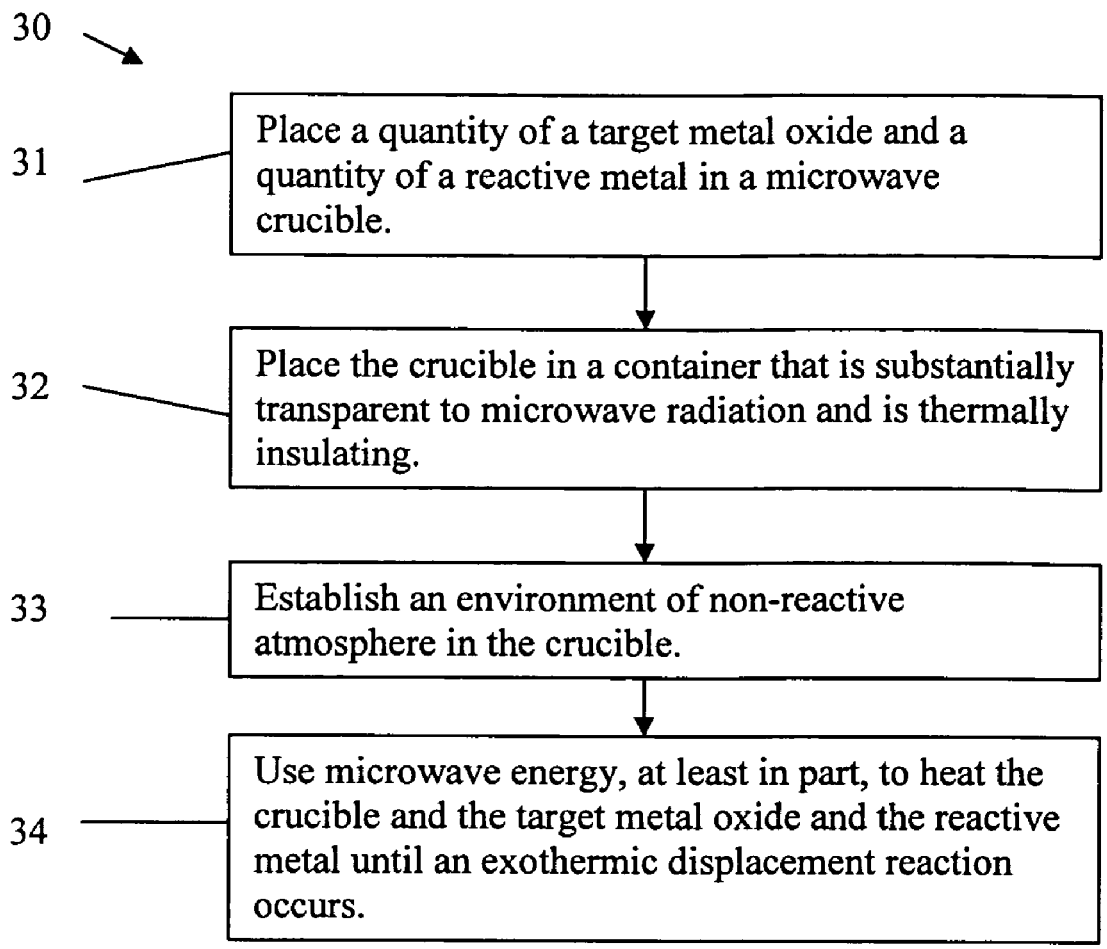
FIG. 3 is a flow chart of a method according to the invention.

FIG. 3 provides a flow chart of a further alternate method 30. In step 31, a quantity of a target metal oxide comprising an elemental metal, and a quantity of a reactive metal, are placed in a crucible. The composition of the crucible is selected so that at ambient temperature the crucible absorbs substantially more microwave energy than the combined quantity of the target metal oxide and the reactive metal absorbs. Also, the reactive metal is selected so that it is (a) a metal that reacts exothermally in a displacement reaction when heated with the target metal oxide, and (b) is introduced and maintained in the crucible in an environment of non-reactive atmosphere, and (c) has a predominant stable oxide that is more chemically stable than the target metal oxide. The quantity of the reactive metal is not less than approximately stoichiometrically equivalent to the quantity of the target metal oxide in the crucible. Optionally a flux agent may be placed in the crucible, where the flux agent has a molten density that is between (a) the molten density of the predominant stable oxide of the metal and (b) the molten density of the elemental metal of the target metal oxide, and where at the temperatures employed in this process the flux agent does not significantly react with the target metal oxide, or with the reactive metal, or with the elemental metal of the target metal oxide, or with the predominant stable oxide of the reactive metal. In step 32, the crucible is placed in a casket that is substantially transparent to microwave radiation and is thermally insulating. Then an environment of non-reactive atmosphere in the crucible is established in step 33. In step 34, microwave energy is used at least in part to heat the crucible and the target metal oxide and the reactive metal until an exothermic displacement reaction occurs. In that reaction, substantially all of the target metal oxide is reduced to the elemental metal and an approximately stoichiometric portion of the reactive metal is oxidized to the predominant stable oxide.

Figure 4:
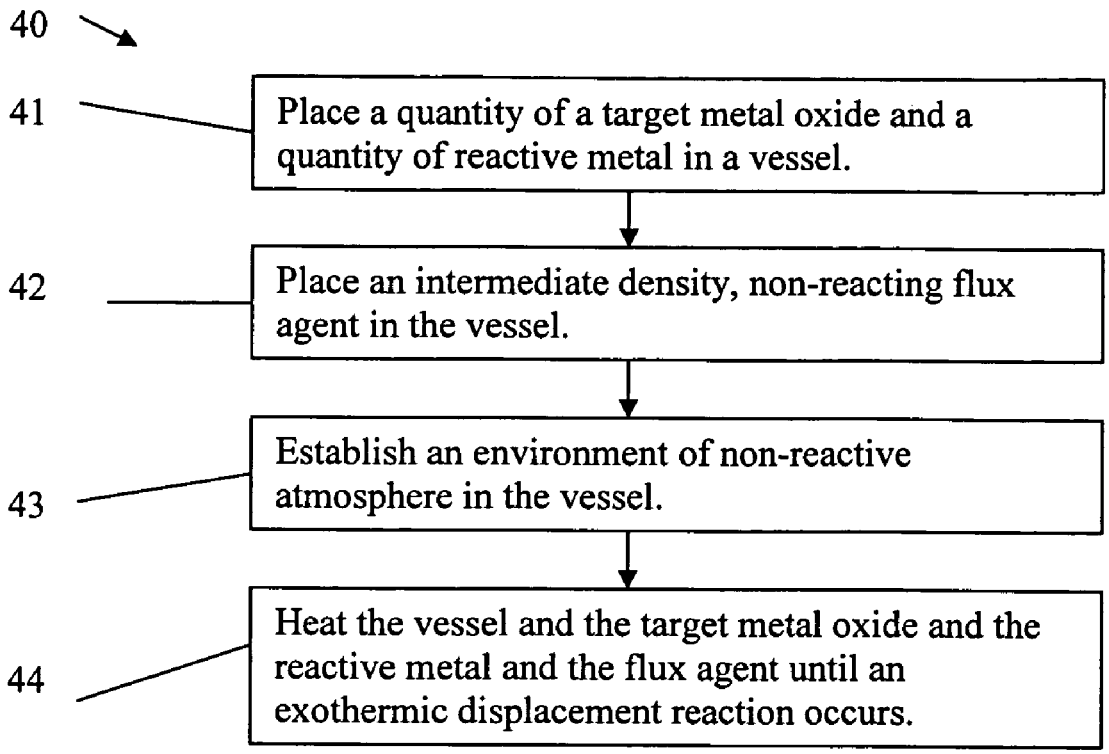
FIG. 4 is a flow chart of a method according to the invention.

FIG. 4 presents method 40 for reducing a target metal oxide to elemental metal. Method 40 begins with step 41 where a quantity of a target metal oxide comprising an elemental metal, and a quantity of reactive metal, are placed in a vessel. The reactive metal (a) is a metal that reacts exothermally in a displacement reaction when heated with the target metal oxide, (b) is introduced and maintained in the vessel in an environment of non-reactive atmosphere, and (c) has a predominant stable oxide that is more chemically stable than the target metal oxide. Also, the quantity of the reactive metal is not less than approximately stoichiometrically equivalent to the quantity of the target metal oxide in the vessel. In step 42, a flux agent is placed in the vessel. The flux agent has a molten density that is between (a) the molten density of the predominant stable oxide of the metal and (b) the molten density of the elemental metal of the target metal oxide. Also, the flux is selected so that at the temperatures employed in this process the flux agent does not significantly react with the target metal oxide, or with the reactive metal, or with the elemental metal of the target metal oxide, or with the predominant stable oxide of the reactive metal. In step 43 an environment of non-reactive atmosphere is established and maintained in the vessel. The vessel and the target metal oxide and the reactive metal and the flux agent are heated in step 44 until an exothermic displacement reaction occurs whereby substantially all of the target metal oxide is reduced to the elemental metal and a stoichiometric portion of the reactive metal is oxidized to the predominant stable oxide.

Figure 5:
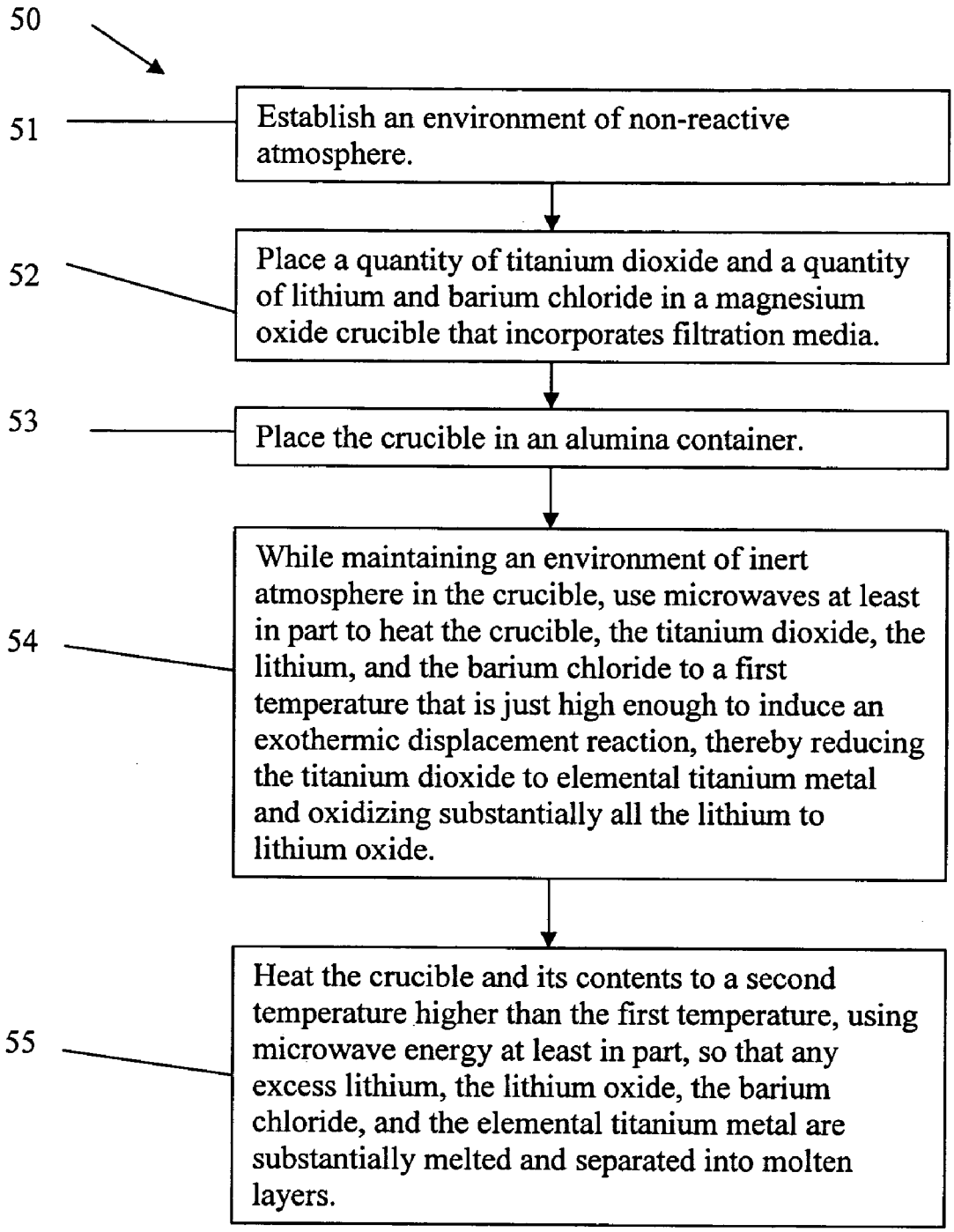
FIG. 5 is a flow chart of a method according to the invention.

FIG. 5 portrays process 50 for reducing titanium dioxide to elemental titanium metal. Process 50 begins with step 51, where a non-reactive atmosphere is established. In step 52, a quantity of titanium dioxide and a quantity of lithium and barium chloride are placed in a crucible, under the non-reactive atmosphere. The composition of the crucible is substantially magnesium oxide, and the crucible comprises a vessel with filtration media. The quantity of lithium is not less than approximately stoichiometrically equivalent to the quantity of titanium dioxide. In step 53, the crucible is placed in an alumina casket. Then in step 54, while maintaining an environment of inert atmosphere in the crucible, the crucible, the quantity of titanium dioxide, the quantity of lithium, and the quantity of barium chloride are heated to a first temperature, using microwave energy at least in part. The first temperature is just sufficiently high enough that the quantity of titanium dioxide and the quantity of lithium react in an exothermic displacement reaction, and substantially all of the quantity of titanium dioxide is reduced to elemental titanium metal and substantially all of the quantity of lithium is oxidized to lithium oxide. In step 55, the crucible and the contents of the crucible are heated to a second temperature that is higher than the first temperature, using microwave energy at least in part, whereby any stoichiometric excess of the quantity of lithium, the quantity of lithium oxide, the quantity of barium chloride, and the quantity of elemental titanium metal are substantially melted and separated into molten layers.

Figure 6:
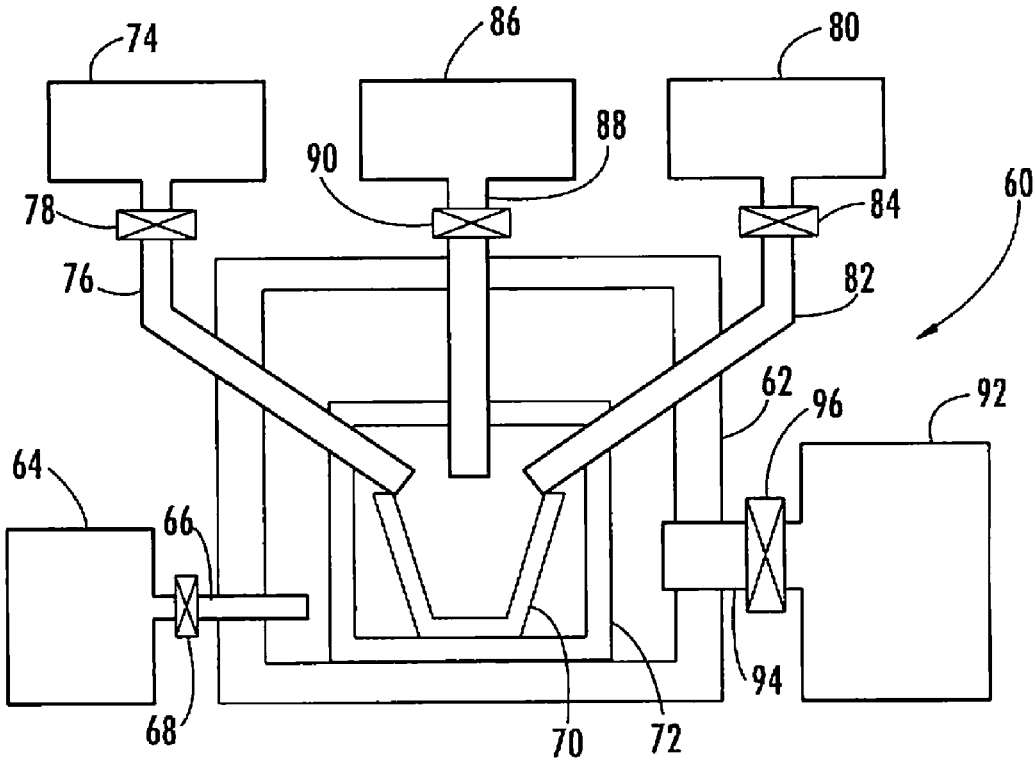
FIG. 6 is an apparatus according to the invention.

FIG. 6 depicts an apparatus according to the invention. Apparatus 60 is an apparatus for reducing a target metal oxide to elemental metal. It includes an enclosure 62 that may be a furnace, a microwave applicator, or a large crucible. A source 64 for non-reactive atmosphere is provided. A non-reactive atmosphere may be provided to the interior of enclosure 62 through atmosphere conduit 66, under the control of atmosphere valve 68. A vessel 70 is installed inside enclosure 62. When enclosure 62 is a microwave applicator, vessel 70 typically comprises a composition of matter that is refractory and is a susceptor of microwave radiation. When enclosure 62 is another form of heating chamber, vessel 70 may be another form of refractory. In the embodiment of FIG. 6, vessel 70 is housed in a casket 72. Casket 72 is designed to retain heat around vessel 70. In embodiments where enclosure 62 is a microwave applicator, casket 72 typically comprises material that is transparent to microwave radiation. Apparatus 60 also includes a metal oxide container 74. Metal oxide container 74 is provided to supply metal oxide material to vessel 70 through metal oxide conduit 76 under the control of metal oxide gate 78. A reactive metal container 80 is also provided. Reactive metal container 80 provides a supply of reactive metal to vessel 70 through reactive metal conduit 82 under the control of reactive metal gate 84. Apparatus 50 also includes a flux container 86. Flux container 86 may be used to provide flux to vessel 70 through flux conduit 88 under the control of flux gate 90. A heater 92 is also provided. Heater 92 provides heat to enclosure 62 through heat conduit 94, under the control of heat controller 96. In embodiments where enclosure 62 is a microwave applicator, heater 92 is generally a microwave generator and heat conduit 94 is a wave guide.

EXAMPLE

A small quantity (approximately 25 grams) of substantially pure titanium dioxide powder was placed in a baked-out MgO crucible on top of approximately 9.12 grams (approximately a 5% stoichiometric excess) of substantially pure Li granules that were on the bottom of the crucible, and the crucible was placed in a microwave oven containing an argon atmosphere. In this specific experiment the materials were ground to approximately 6 mesh or less. The argon atmosphere was used to prevent the spontaneous oxidation of the lithium metal that would occur in air. The MgO crucible was preferentially selected to be non-reactive with both the reactants and the reaction products and was also selected to be a susceptor to microwave energy. The crucible was closed with a lid and the configuration included a porous calcium oxide vent to permit off-gassing while trapping metal and salt vapors that would contaminate the furnace when the crucible was heated in a subsequent step. Calcium oxide was selected as the filtration media because it has a higher melting temperature than the reaction product off gases. The crucible was placed inside a thermally insulating ceramic aluminum oxide casket. The casket and the crucible with its charge and filtration media were placed inside a 12 kilowatt multi-mode 2.45 GHz microwave oven that was evacuated, and then back-filled and continually purged with argon in order to continue to prevent the spontaneous oxidation of the lithium metal. The microwave furnace was energized, heating the MgO crucible. The thermal insulation helped contain the heat within the crucible and its contents. Approximately fifty-six minutes after energizing the microwave furnace, the exothermic reaction of the titanium dioxide and lithium had occurred, and the furnace was de-energized. When the crucible was cooled and opened, particles of sponge-like titanium metal, verified visually, were found on the bottom of the crucible surrounded by other reaction products.

The foregoing description of certain embodiments of this invention has been provided for the purpose of illustration only, and various modifications may be made without affecting the scope of the invention as set forth in the following claims. Although some embodiments are shown to include certain features, the inventors specifically contemplate that any feature disclosed herein may be used together or in combination with any other feature on any embodiment of the invention. It is also contemplated that any feature may be specifically excluded from any embodiment of an invention.

We claim:

1. A process for reducing a target metal oxide to elemental metal comprising:

coarsely grinding a quantity of a target metal oxide comprising an elemental metal and placing the coarsely-ground quantity of the target metal oxide in a vessel;

while in a non-reactive atmosphere, coarsely grinding a quantity of a reactive metal and placing the coarsely-ground quantity of the reactive metal in the vessel, wherein the reactive metal is a metal that reacts exothermally in a displacement reaction when heated with the target metal oxide, and wherein the reactive metal has a predominant stable oxide that is more chemically stable than the target metal oxide;

while providing a non-reactive atmosphere in the vessel, substantially mixing the quantity of target metal oxide with the quantity of reactive metal in the vessel;

while in an environment of the non-reactive atmosphere, heating the contents of the vessel to a first temperature sufficient to reduce at least a portion of the target metal oxide to the elemental metal and to oxidize at least a portion of the reactive metal to the predominant stable oxide;

heating the contents of the vessel to a second temperature sufficient to substantially melt the elemental metal and to melt the predominant stable oxide of the reactive metal.

2. The process of claim 1 further comprising:

prior to heating the contents of the vessel to the first temperature, placing a flux agent in the vessel, wherein the flux agent has a molten density that is between (a) the molten density of the predominant stable oxide of the reactive metal and (b) the molten density of the elemental metal of the target metal oxide, and wherein at the first temperature the flux agent does not significantly react with the target metal oxide, or with the reactive metal, or with the element of the target metal oxide, or with the predominant stable oxide or the reactive metal, and wherein at the second temperature , the flux agent is substantially melted to form a separate molten layer.

3. The process of claim 2 wherein the target metal oxide comprises titanium dioxide;

the reactive metal comprises lithium; and the flux agent comprises barium chloride.

4. The process of claim 1 wherein the vessel includes a filtration media.

5. The process of claim 1 wherein the quantity of reactive metal is not less than approximately stoichiometrically equivalent to the quantity of target metal oxide in the vessel.

6. The process of claim 1 wherein the second temperature is sufficient (a) to melt any excess of the reactive metal, the predominant stable oxide of the reactive metal, and the elemental metal of the target metal oxide and (b) to provide separate molten layers.

7. A process for reducing a target metal oxide to elemental metal comprising:

placing a quantity of a target metal oxide comprising an elemental metal in a first vessel;

placing a quantity of a reactive metal in a second vessel, wherein the reactive metal (a) is a metal that reacts in an exothermic displacement reaction when heated with the target metal oxide, and (b) has a predominant stable oxide that is more chemically stable than the target metal oxide;

establishing a combination of temperatures of the contents of the first vessel and the second vessel that is sufficient to substantially melt and separate into molten layers the combined contents of the vessels after an exothermic displacement reaction occurs;

while in an environment of a non-reactive atmosphere, combining the contents of the first vessel with the contents of the second vessel into the combination vessel wherein the exothermic displacement reaction occurs and at least a portion of the target metal oxide is reduced to the elemental metal and at least a portion of the reactive metal is oxidized to the predominant stable oxide, and wherein the elemental metal is substantially melted.

8. The process of claim 7 wherein establishing a combination of temperatures of the contents of the first vessel and the second vessel comprises:

providing a crucible for at least one of the first and second vessels wherein at ambient temperature the crucible absorbs microwave energy;

placing the crucible in a thermal insulator that is substantially transparent to microwave radiation; and while maintaining an environment of non-reactive atmosphere in the crucible, using microwave energy at least in part to heat the crucible and its contents.

9. The process of claim 8 further comprising:

prior to maintaining an environment of non-reactive atmosphere in the crucible and using microwave energy at least in part to heat the crucible and its contents, placing a flux agent in the crucible, wherein the flux agent has a molten density that is between (a) the molten density of the predominant stable oxide of the metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal, and wherein after heating the contents of the crucible, the flux agent is substantially melted and forms a separate molten layer.

10. The process of claim 7 further comprising:

prior to establishing the combination of temperatures of the contents of the first vessel and the second vessel, placing a flux agent in at least one of the vessels wherein the flux agent has a molten density that is between (a) the molten density of the predominant stable oxide of the reactive metal and (b) the molten density of the elemental metal of the target metal oxide, and wherein at the temperatures employed in this process the flux agent does not significantly react with the target metal oxide, the reactive metal, the elemental metal of the target metal oxide, or the predominant stable oxide of the reactive metal, and wherein after heating the contents of the crucible, the flux agent is substantially melted and forms a separate molten layer.

11. The process of claim 10 in which:

the target metal oxide comprises titanium dioxide;

the reactive metal comprises lithium; and the flux agent comprises barium chloride.

12. The process of claim 10 in which the flux agent is coarsely ground.

13. The process of claim 7 in which:

the combination vessel comprises a vessel having a filtration media.

14. The process of claim 7 further comprising the steps of coarsely grinding the quantity of target metal oxide prior to placing it in the first vessel;

coarsely grinding the quantity of reactive metal in a non-reactive atmosphere prior to placing it in the second vessel.

15. The process of claim 7 wherein the quantity of reactive metal is not less than approximately stoichiometrically equivalent to the quantity of target metal oxide in the vessel.

16. A process for reducing a target metal oxide to elemental metal comprising:

placing a quantity of a target metal oxide comprising an elemental metal, and a quantity of a reactive metal, in a crucible that at ambient temperature absorbs microwave energy and wherein the reactive metal is (a) a metal that reacts exothermally in a displacement reaction when heated with the target metal oxide, (b) is maintained in the crucible in an environment of non-reactive atmosphere, and (c) has a predominant stable oxide that is more chemically stable than the target metal oxide;

placing the crucible in a thermal insulator that is substantially transparent to microwave radiation;

while maintaining an environment of non-reactive atmosphere in the crucible and heating the crucible and the target metal oxide and the reactive metal, using microwave energy at least in part, until an exothermic displacement reaction occurs wherein at least a portion of the target metal oxide is reduced to the elemental metal and at least a portion of the reactive metal is oxidized to the predominant stable oxide.

17. The process of claim 16 further comprising:

after the exothermic displacement reaction occurs, further heating the crucible and the contents of the crucible until any excess of the reactive metal, the predominant stable oxide of the reactive metal, and the elemental metal of the target metal oxide are substantially melted and separated into molten layers.

18. The process of claim 16 in which:

the crucible comprises a vessel having a filtration media.

19. The process of claim 16 further comprising the step of:

coarsely grinding the quantity of target metal oxide and while in an environment of non-reactive atmosphere coarsely grinding the quantity of reactive metal prior to placing them in the crucible.

20. The process of claim 16 further comprising:

prior to placing the crucible in a casket that is substantially transparent to microwave radiation and is thermally insulating, placing a flux agent in the crucible, wherein the flux agent has a molten density that is between (a) the molten density of the predominant stable oxide of the metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal, and wherein after heating the contents of the crucible to a first temperature, the flux agent is substantially melted and forms a separate molten layer.

21. The process of claim 20 further comprising:

after the exothermic displacement reaction occurs, further heating the crucible and the contents of the crucible to a second temperature until any stoichiometric excess of the reactive metal, the predominant stable oxide of the reactive metal, and the elemental metal of the target metal oxide are substantially melted and separated into molten layers.

22. The process of claim 20 in which:

the target metal oxide comprises titanium dioxide;

the reactive metal comprises lithium; and the flux agent comprises barium chloride.

23. The process of claim 20 further comprising the steps of coarsely grinding the quantity of target metal oxide prior to placing it in the crucible;

while in an environment of non-reactive atmosphere, coarsely grinding the quantity of reactive metal prior to placing it in the crucible;

coarsely grinding the flux agent prior to placing it in the crucible; and while in an environment of non-reactive atmosphere, substantially mixing the quantity of target metal oxide with the quantity of reactive metal and with the flux agent prior to the step of heating.

24. The process of claim 16 wherein the quantity of reactive metal is not less than approximately stoichiometrically equivalent to the quantity of target metal oxide in the crucible.

25. A process for reducing a target metal oxide to elemental metal comprising:

placing a quantity of a target metal oxide comprising an elemental metal, and a quantity of reactive metal, in a vessel wherein the reactive metal (a) is a metal that reacts exothermally in a displacement reaction when heated with the target metal oxide, (b) is maintained in the vessel in an environment of non-reactive atmosphere, and (c) has a predominant stable oxide that is more chemically stable than the target metal oxide;

placing a flux agent in the vessel, wherein the flux agent has a molten density that is between (a) the molten density of the predominant stable oxide of the metal and (b) the molten density of the elemental metal of the target metal oxide, and wherein at the temperatures employed in this process the flux agent does not significantly react with the target metal oxide, or with the reactive metal, or with the elemental metal of the target metal oxide, or with the predominant stable oxide of the reactive metal;

while maintaining an environment of non-reactive atmosphere in the vessel, heating the vessel and the target metal oxide and the reactive metal and the flux agent until an exothermic displacement reaction occurs wherein at least a portion of the target metal oxide is reduced to the elemental metal and at least a portion of the reactive metal is oxidized to the predominant stable oxide, and the elemental metal is melted and the flux separates the melted elemental metal from the other contents of the vessel.

26. The process of claim 25 in which:

the vessel comprises a vessel with filtration media.

27. The process of claim 25 further comprising the step of:

coarsely grinding the quantity of target metal oxide and while in an environment of non-reactive atmosphere coarsely grinding the quantity of reactive metal prior to placing them in the vessel.

28. The process of claim 25 in which:

the target metal oxide comprises titanium dioxide;

the reactive metal comprises lithium; and the flux agent comprises barium chloride.

29. The process of claim 25 wherein the quantity of reactive metal is not less than approximately stoichiometrically equivalent to the quantity of target metal oxide in the vessel.

30. A process for reducing titanium dioxide to elemental titanium metal comprising:

while in a non-reactive atmosphere, placing a quantity of titanium dioxide and a quantity of lithium and barium chloride in a crucible composed substantially of magnesium oxide, wherein the crucible comprises a vessel with filtration media, and wherein the quantity of lithium is not less than approximately stoichiometrically equivalent to the quantity of titanium dioxide;

placing the crucible in an alumina casket;

while maintaining an environment of a non-reactive atmosphere in the crucible, heating the crucible, the quantity of titanium dioxide, the quantity of lithium, and the quantity of barium chloride to a first temperature, using microwave energy at least in part, the first temperature being just sufficiently high so that the quantity of titanium dioxide and the quantity of lithium react in an exothermic displacement reaction, and substantially all of the quantity of titanium dioxide is reduced to elemental titanium metal and substantially all of the quantity of lithium is oxidized to lithium oxide;

heating the crucible and the contents of the crucible to a second temperature higher than the first temperature, using microwave energy at least in part, wherein any stoichiometric excess of the quantity of lithium, the quantity of lithium oxide, the quantity of barium chloride, and the quantity of elemental titanium metal are substantially melted and separated into molten layers.

31. The process of claim 30 further comprising the steps of:

coarsely grinding the quantity of titanium dioxide and the quantity of barium chloride prior to placing the quantities in the crucible;

while in an inert atmosphere, coarsely grinding the quantity of lithium prior to placing it in the crucible; and while in an inert atmosphere, substantially mixing the quantity of titanium dioxide with the quantity of lithium and with the quantity of barium chloride prior to heating to the first temperature.

32. The process of claim 1 wherein the step of heating the contents of the vessel to a second temperature comprises heating the contents of the vessel to a second temperature less than about 1700° C.

* * * * *